United States Patent [19]

Smith et al.

[11] 3,942,474

[45] Mar. 9, 1976

[54] DEVELOPING SYSTEMS

[75] Inventors: Richard E. Smith, Webster; Jack R. Oagley, Rochester, both of N.Y.

[73] Assignee: Xerox Corporation, Stamford, Conn.

[22] Filed: Sept. 13, 1974

[21] Appl. No.: 505,712

Related U.S. Application Data

[60] Continuation of Ser. No. 313,080, Dec. 7, 1972, abandoned, which is a division of Ser. No. 838,142, July 1, 1969, abandoned.

[52] U.S. Cl. ..... 118/637; 118/DIG. 23; 427/15; 427/21

[51] Int. Cl.[2] ..... G03G 15/06

[58] Field of Search ..... 117/37 LE, 93.4 A; 118/7, 118/203, 242, 261, 262, DIG. 23, 637

[56] References Cited

UNITED STATES PATENTS

| | | | |
|---|---|---|---|
| 2,589,966 | 3/1952 | Rullo | 118/249 |
| 2,811,465 | 10/1957 | Greig | 118/637 |
| 3,084,043 | 4/1963 | Gundlach | 118/DIG. 23 |
| 3,089,415 | 5/1963 | Grembecki et al. | 118/262 |
| 3,410,713 | 11/1968 | Schneidereit | 117/37 LE |
| 3,500,793 | 3/1970 | Bartusek | 118/637 |
| 3,561,400 | 2/1971 | Smitzer | 118/637 |
| 3,626,833 | 12/1971 | Koch | 95/89 R |

*Primary Examiner*—Mervin Stein
*Assistant Examiner*—Douglas Salser
*Attorney, Agent, or Firm*—John E. Crowe; James J. Ralabate; James P. O'Sullivan

[57] ABSTRACT

A development system comprising a small compact modular developer unit which is retractably engagable with an image bearing surface is provided. The developer module contains within its casing developer feed and doctoring systems to provide a developer applicator surface containing appropriate quantities of developer. The system may use liquid and powder developers and is capable of high speed operation.

14 Claims, 5 Drawing Figures

DEVELOPING SYSTEMS

This is a continuation of application Ser. No. 313,080, filed Dec. 7, 1972, now abandoned, which is a division of application Ser. No. 838,142, filed July 1, 1969, now abandoned.

BACKGROUND OF THE INVENTION

This invention relates to imaging systems, and more particularly to improved development systems.

The formation and development of images of photoconductive material by electrostatic means is well known. The basic xerographic process, as taught by C. F. Carlson in U.S. Pat. No. 2,297,691, involves placing a uniform electrostatic charge on a photoconductive insulating layer, exposing the layer to a light-and-shadow image to dissipate the charge on the areas of the layer exposed to the light and developing the resulting electrostatic latent image by depositing on the image a finely-divided electroscopic material refered to in the art as "toner." The toner will normally be attracted to those areas of the layer which retain a charge, thereby forming a toner image corresponding to the electrostatic latent image. This powder may then be transferred to a support surface such as paper. The transferred image may subsequently be permanently affixed to the support surface as by heat. Instead of latent image formation by uniformly charging the photoconductive layer and then exposing the layer to a light-and-shadow image, one may form the latent image by directly charging the layer in the image configuration. The powder image may be fixed to the photoconductive layer if elimination of the powder image transfer step is desired. Other suitable fixing means such as solvent or over coating treatment may be substituted for the foregoing heat fixing step.

Similar methods are known for applying electroscopic particles to electrostatic latent images to be developed. Included within this group are the "cascade" development technique disclosed by E. N. Wise in U.S. Pat. No. 2,618,552, the "magnetic brush" process disclosed in U.S. Pat. No. 2,874,063, and the "powder cloud" process disclosed by C. F. Carlson in U.S. Pat. No. 2,221,776, the disclosures of which are hereby incorporated by reference.

An additional dry development system and the dry system to which this invention is most nearly directed involves developing an electrostatic latent image with a powder developer material, the powder having been uniformly applied to the surface of the powder applicator. The latent image is brought close enough to the developer powder applicator so that the developer powder is pulled from the applicator to the charge bearing surface in image configuration. The image and powder applicator may desirably be brought in contact including contact under pressure to effect development. The powder applicator may be either smooth surfaced or patterned so that the developer powder is carried in the depressed portions of the pattern surface. Exemplary of this system are the techniques disclosed by H. G. Greig in U.S. Pat. No. 2,811,465.

A further technique for developing electrostatic latent images is the liquid development process developed by R. W. Gundlach in U.S. Pat. No. 3,084,043. In this method an electrostatic image is developed or made visible by presenting to the imaging surface a liquid developer from the surface of a developer dispensing member having the plurality of raised portions or "lands" defining a substantially regular surface and a plurality of portions depressed below the raised portions or "valleys." The depressed portions contain a layer of conductive liquid developer which is maintained out of contact with the electrostatographic imaging surface. The development system disclosed in U.S. Pat. No. 3,084,043 hereinafter referred to as the "polar liquid development" system, differs from conventional electrophoretic liquid development systems where substantial contact between liquid developer and both the charged and uncharged areas of the electrostatic latent image occurs. Unlike electrophoretic development, substantial contact between the polar liquid and the areas of the electrostatic latent image bearing surface not to be developed is preferably prevented in the polar liquid development technique. Reduced contact between liquid developer and the non-image areas of the surface to be developed is desirable because the formation of background deposits is thereby inhibited. Another characteristic which distinguishes the polar liquid development technique from electrophoretic processes is the fact that the liquid phase of a developer actually takes part in the development of a surface. The liquid phase of an electrophoretic liquid developer functions only as a carrier medium for the developer particles.

An additional development technique is that referred to as "wetting development" described in U.S. Pat. No. 3,285,741. In this technique an aqueous developer uniformly contacts the entire imaging surface and due to the selected wetting and electrical properties of the developer substantially only the charged areas of the imaging surface are wetted by the developer.

All these systems have demonstrated good capability in producing developed copies of satisfactory quality. However, the individual systems when employed as commercial embodiments suffer serious deficiencies and drawbacks. In the dry development systems relatively large, bulky, complicated mechanical devices must be employed to effectively accomplish development since the developer materials are presented to the surface in excess quantities which must be removed and the developer materials are also recycled for subsequent development operations. Also, in some of these devices the developer material generally contacts the entire image bearing surface with resulting background deposits on the developed image. Furthermore, the relative free mobility of developer material in such devices yields rather untidy development systems and the possibility of chemical contamination of copy paper, photoreceptor or some mechanical means is always present.

Similar problems often exist in devices employing liquid development systems. Here also the entire image bearing surface may be contacted by the liquid developer increasing the possibility of undesirable background deposits and contributing to the use of excess quantities of developer. Similarly the relatively uncontrolled movement of liquid developer in the device contributes to waste and spillage of developer with the ever attendent possibility of chemical attack of some mechanical part. A particularly significant effect of the unconstrained movement of liquid developer may be contamination of the copy paper supply.

In either the dry or liquid development systems but particularly in the liquid development systems, the developer applicator surface is usually in continuous contact with a portion of the imaging surface. During periods of intermittent use or nonuse the developer present on the applicator may chemically attack the imaging surface resulting in pitting or other surface discontinuities and in the instance where a binder layer photoconductor is used as the imaging surface the developer may completely destroy a portion of the photoconductor resulting in breakdown of the development system. Furthermore, with any binder layer photoconductor the resin binder on attack by the developer may be present thereafter as a contaminant in the developer. Any attacked or degraded photoconductor residue may also be transferred to the surface of the applicator resulting in a non-uniform applicator surface, or in the case of a patterned surface resulting in deposits in the depressed portions of the applicator surface. In addition, the continuous contact which may be under pressure between applicator surface and photoconductor during prolonged idleness may result in the formation of flat splts on one of the surfaces.

Particular difficulty in those systems using a single use or reusable photoconductor is the fact that the entire charged portion of the photoconductor, which may be larger that the image portion, is developed and any copy resulting therefrom may contain deposited or transferred developer in other than image areas.

It is, therefore, clear that there is a continuing need for a better system for developing electrostatic latent images.

SUMMARY OF THE INVENTION

It is, therefore, an object of this invention to provide a developing system which overcomes the above noted deficiencies.

It is another object of this invention to provide a simple compact development system.

It is another object of this invention to provide a developer system where the developer applicator surface contacts substantially only the image area on the imaging surface to be developed.

It is another object of this invention to provide a movable modular developer system.

It is another object of this invention to provide a retractable developer applicator system.

It is another object of this invention to provide a cleaner operating developer system.

It is another object of this invention to provide a development system which forms images having reduced background deposits.

It is another object of this invention to provide a development system having reduced developer consumption.

It is another object of this invention to provide a development system having reduced maintenance requirements.

It is another object of this invention to provide a development system capable of continuous development.

It is another object of this invention to provide a continuous development system having little or no linear cumulative error in the development cycle.

It is another object of this invention to provide a development system which is superior to known development systems.

The above objects and others are accomplished, generally speaking, by providing a development system employing a developer module which is retractable from developing engagement with the electrostatographic imaging surface and wherein the developer module is a substantially closed, self-contained, compact unit with exposure to outside surfaces only where necessary. More particularly, the applicator module comprises within its confines a system to supply developer material to an applicator surface and a doctoring system to provide metered amounts of developer in doctored configuration on the applicator surface. The applicator in the developer module is a path defining surface along a portion of which the developer module is open to the exterior to permit developing engagement with an image bearing surface. All elements in the developer module are securely but movably positioned in their necessary configuration and this alignment of elements is continuously maintained. The entire developer module is pivotably mounted about a shaft extending its longitudinal length and is spring loaded to position the applicator surface in developing engagement with the photoconductor surface. The developer module is retractably disengageable from developing engagement with the surface of the imaging surface by any suitable means, such as a cam, in such a manner that the developer module is in developing configuration only along a predetermined path of the imaging surface. That is, the developer applicator is retractable from developing engagement during that portion of the photoconductor path which does not bear an electrostatic latent image to be developed. The developer applicator is in developing engagement substantially only when that portion of the photoconductor path bearing an image to be developed is also in developing engagement.

The invention may be further illustrated by reference to the accompanying drawings in which.

Figure 1:
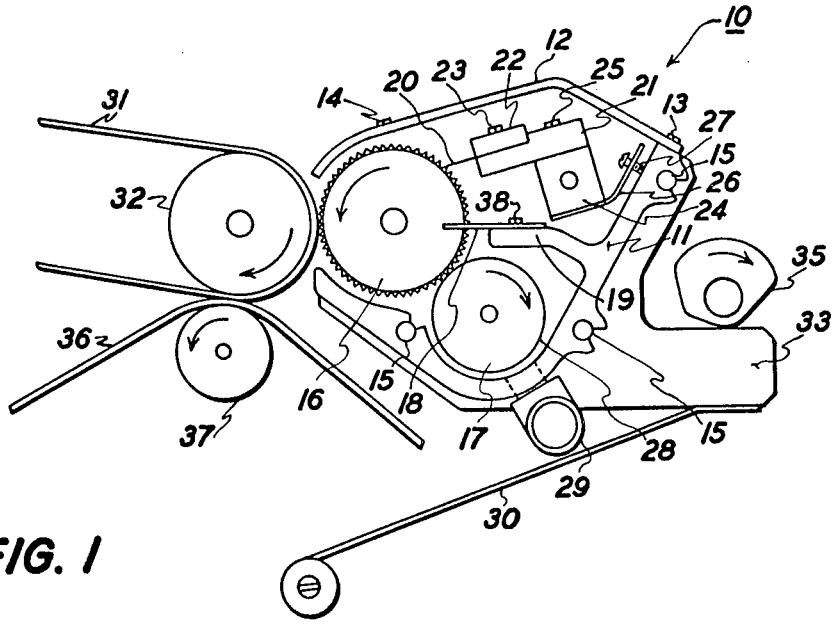
FIG. 1 is an end view of an embodiment of the present invention with end plate removed.

In FIG. 1 the developer module generally designated as 10, comprises developer tray or housing 11 which may be of one piece construction. Developer tray 11 may, for example, be an extruded aluminum tray. Developer cover 12 provides the top enclosure of the developer module and is securely fastened to the end plates (not shown) of the developer module by means of two or more screws 13 and 14. End plates (not shown) are securely fastened to the developer tray 11 by means of screws 15 at each end of the developer tray. Developer applicator roll 16 in the developer tray is rotatably mounted about its longitudinal axis through a bearing on each end plate. Feed roller 17 is rotatably mounted in the developer tray about its longitudinal axis in bearing in each of the end plates. Edge and corner doctor blade 18 is positioned on support arm 19 of developer tray or housing 11 by any suitable means such as screw 38. Main doctor blade 20 is fastened onto support member 21 by means of clamp 22 held in place by screws 23. The doctor blade support 21 is securely mounted on pivot shaft 24 by means of screw 25. Pivot shaft 24 which is cylindrically shaped at its ends to pivot within the end plates is spring loaded in position by flat spring 26 which may provide adjustable tensioning by means of set screw 27. Developer material is fed to the bath or reservoir portion of developer tray generally designated as 28 by means of conduit 29 attached to a larger developer supply. Developer may preferably be supplied to the bath or reservoir portion of the developer tray by gravity feeding means. Developer module 10 is held in developing engagement with the photoconductor 31, here illustrated as a web, belt or sheet type photoconductor supported in place by support roller 32, by means of leaf spring 30 which is in tensioning engagement with end plate 33 securely mounted to the developer tray 11 by means of screws 15. The top portion of end plate 33 provides the cam receiving surface for cam 35 which on rotation engages the camming surface thereby rotating the developer module about its pivot shaft which may be an extension of the feed roll shaft and disengaging the applicator surface from developing engagement. A single spring and/or cam may be employed. To insure uniform pressure contact it is preferred to provide springs at each end of the developer module. Similarly two cams may be employed. The developer module is rotatably mounted in the overall machine structure to provide the described engagement and disengagement of the applicator surface relative to the imaging surface.

In the embodiment shown in FIG. 1, the photoconductor web may, by any conventional means, be charged and exposed to a pattern to be reproduced producing an electrostatic latent image on the photoconductor. During the charging step the applicator module, which is disengaged from developing engagement, may be actuated by any suitable mechanical programming system to prime the applicator surface with developer. During this priming operation and continuously during the development cycle, the rotating feed roll in developer transfer engagement with the applicator roll delivers the developer from the developer bath to the surface of the rotating applicator roll. Since in this embodiment the developer is present on the applicator surface in nonuniform configuration the applicator surface is doctored first with edge and corner doctoring surfaces and secondly with a principal doctoring surface extending the entire longitudinal length of the applicator surface. The path defining applicator surface containing metered amounts of developer in doctored configuration is then advanced to the developing position.

During exposure of the charged photoconductor, the programming system may interrupt the priming of the applicator surface as all movement is preferably stopped to insure the best definition of image on the photoconductor. After exposure the programming system advances the portion of photoconductor bearing an image to be developed toward developing configuration with the applicator surface while simultaneously again actuating the developer module. As the leading edge of the image portion of the photoconductor approaches that point along support roller 32 where developing engagement is made, programming system disengages the cam to permit the spring 30 to bring the applicator module into developing engagement with the leading edge of the image to be developed. Typically, the programming system is driven and all cycles are actuated by the programmer monitoring the length of the photoreceptor passing it at a station near the charging station so that in the development stage the developer module commences developing engagement with the photoconductor along the leading edge of the image to be developed. The photoconductor and applicator surface continue in moving developing engagement until the entire image is developed and when development is complete the programmer actuates the camming mechanism to pivot the entire developer module about its pivot shaft thereby retracting the developer module. If desired, the developed image may be transferred to copy paper 36 held in transfer engagement by backup roll 37. Also the mechanical programmer may be so constructed as to provide developing engagement between the photoconductor and the applicator surface of the developer module along any predetermined length of the photoconductor. However, for the reasons previously discussed it is preferred to employ a mechanical programmer which provides a predetermined length of developing engagement substantially the same as the length of the image to be developed.

The mechanical programmer referred to may be any device which will accurately and repeatedly sequentially time and synchronize all events necessary in the process and machine system. Any suitable means may be employed to provide this mechanism. The mechanical programmer may, for example, consist of a simple device rotating at a fixed rate of speed with activity engaging elements positioned at different portions of a complete cycle so that on the completion of one cycle of the programmer all activities are performed in sequence. The activity engaging elements may be in any form which provides the necessary timed sequence of operations and effectively engage and disengage each operation at the appropriate time. A typical mechanical programmer comprises a gear train from the photoconductor paper feed to the photoconductor backup roll and to a gear mounted on the camming shaft. The inking roll and developer roll may also be driven by this same gear train or may be independently driven. The gear ratios in the gear train may typically be selected so that the cam is engaged at all times other than when the applicator roll is in developing engagement with an image bearing surface. While mechanical timing is preferred in order to minimize error and particularly cumulative error over a period of time, electrical timing or electromechanical timing mechanisms may be used. A typical electromechanical device would comprise a solenoid as depicted in FIG. 2.

Figure 2:
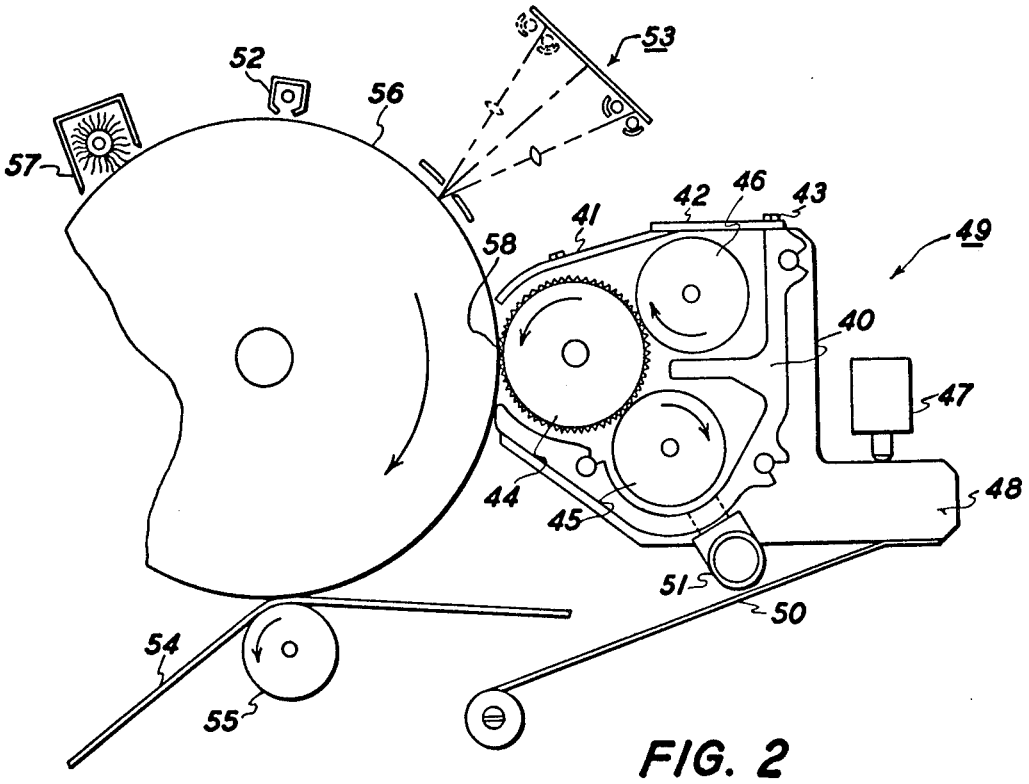
FIGS. 2 and 3 are end views of alternative embodiments of the present invention.

FIG. 2 is an alternative embodiment differing from FIG. 1 in the use of a drum type photoconductor with associated charging, exposing, developed image transfer and cleaning stations. It also differs from FIG. 1 in employing a roll doctor rather than the blade doctors of FIG. 1, and in the use of a solenoid to disengage the developer module. More specifically, the developer module contains developer tray or housing 40 together with cover 41 securely held together by means of clamp 42 and screws 43 to form a substantially enclosed modular system. Rotatably mounted in the end plates (not shown) which are fastened to each end of the developer tray are applicator roll 44, feed roll 45, and doctor roll 46. Solenoid 47 is positioned in engaging configuration with the receiving surface of end plate 48. The developer module generally designated as 49 is held in developing configuration by means of spring 50. During operation, developer may be supplied to the small bath in the developer module by means of conduit 51. The photoconductor on the surface of drum 56 is charged at charging station 52 and exposed at exposure station 53. The latent image on the photoconductor is developed when the applicator surface of the developer module is in developing engagement at developing station 58. The developed image may be transferred to copy paper 54 by placing the paper and developed image in transfer assembly by means of backing roll 55. The surface of photoconductor 56 may thereafter be cleaned at cleaning station 57. The doctor roll 46 employed in this embodiment may be a squeegee type roll doctor or a "skid" type roll doctor.

Figure 3:
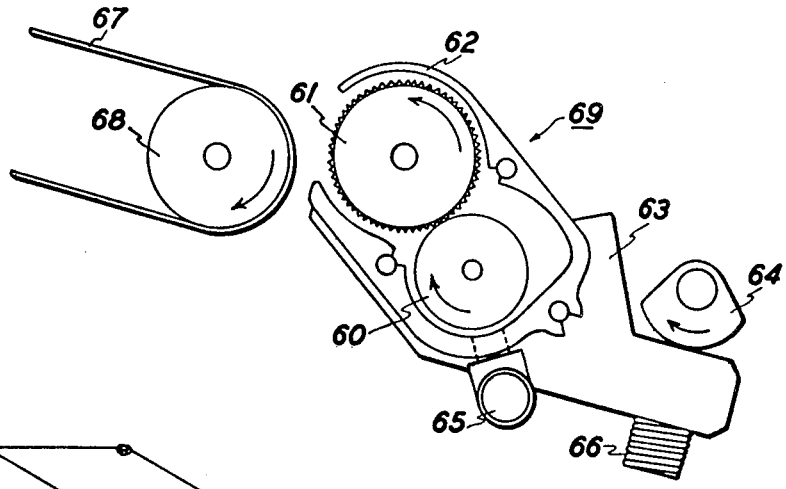

FIG. 3 illustrates a further embodiment of the invention wherein both developer feeding to the applicator surface and doctoring of the applicator surface are achieved with the same surface or device. In particular, roll 60 performs both a feeding function and doctoring of the applicator surface according to the technique described by G. Carr in copending application Ser. No. 838,133 filed concurrently herewith and entitled IMAGING SYSTEMS AND METHODS. More specifically, applicator module 69 is composed of developer tray or housing 62 which may be of one piece construction. End plates 63 are mounted on each end of the housing and rotatably mounted within the end plates are feed and doctor roll 60 in feeding and doctoring engagement with applicator roll 61. External supplies of developer may be received in the developer module through conduit 65. The developer module is depicted as being disengaged from developing engagement by means of cam 64 acting on the cam receiving surface of end plates 63. When placed in developing engagement photoconductor 67 bearing an image to be developed is supported by support roll 68 as coil spring 66 provides the necessary force to place the developer module in developing configuration.

Figure 4:
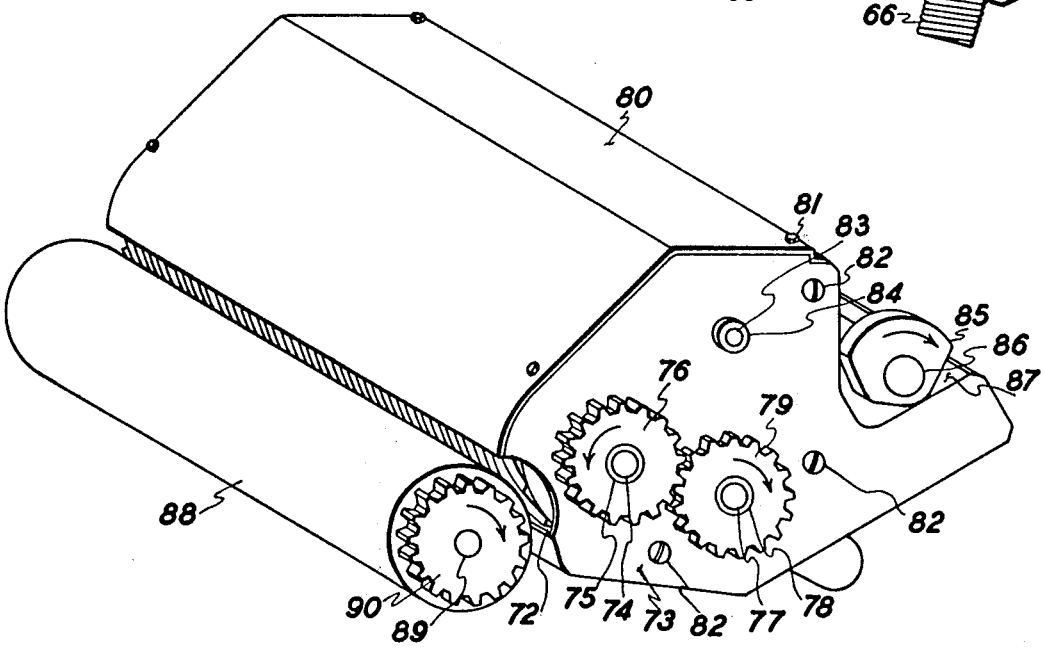
FIG. 4 is a view in perspective of an embodiment of the present invention.

FIG. 4 is a view in perspective of the embodiment of this invention depicted in FIG. 1 and wherein applicator roll 72 is rotatably mounted in end plates 73 about its longitudinal axis 74 securely positioned in bearing 75. The applicator roll 72 may be driven by means not shown through gear 76. The feed roll is rotatably mounted about its longitudinal axis 77 in end plates 73 and is securely positioned in bearing 78. Gear 79 is driven from external means. Cover 80 is securely attached to end plates 73 by means of screws 81 and the end plates 73 are securely attached to the developer tray by means of self tapping screws 82 to provide a substantially enclosed self-contained developer module. Main doctor blade pivot shaft 83 is securely mounted in bearing 84 in end plates 73. Cam 85 is rotatably mounted on shaft 86 which is securely positioned in a fixed external member such as a machine structure. On activation cam 85 rotates about shaft 86 engaging cam receiving surface 87. Image bearing surface backup roll 88 is rotatably mounted about shaft 89 and may be driven from an external source by means of gear 90. In operation backup roll 88, developer module pivot shaft 77 and cam shaft 86 may be securely mounted in a rigid frame structure.

Figure 5:
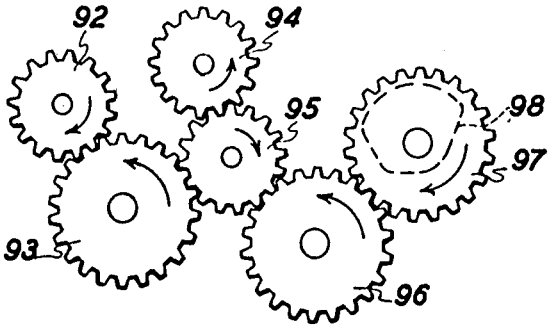
FIG. 5 is a schematic representation of a conventional mechanical programer according to this invention.

FIG. 5 illustrates a typical mechanical programmer to accurately time the orderly sequence of events in any particular machine configuration. Gear 92 may, for example, be mounted on a photoconductor feed mechanism at the charging or exposure station. Gear 92 drives driving gear 93 which in turn drives gear 95 which may be mounted on the shaft of the feed roll. Gear 95 is in driving engagement with gear 94 mounted on the end of the developer roll shaft and with driving gear 96. Gear 96 is in driving engagement with gear 97 mounted on the shaft of cam 98. Any conventional gear train may be employed to accurately program the several operations or functions. In addition the mechanical programmer may be provided by any conventional gear, pulley or belt or combination thereof type actuation train. The gear ratios, for example, are selected to provide the desired programming. The precise gear ratios employed are dependent on the exact configuration of the final machine assembly and may readily be determined by one skilled in the art for any particular assembly.

The applicator surface may be of any suitable configuration and size. It may, for example, take the form of a rotatably mounted roller as shown in the several figures or it may be in the form of a movable endless web or belt. The surface may be smooth but preferably is a uniformly patterned surface of raised portions or lands and depressed portions or valleys. A typical applicator is a cylindrical roll having a trihelecoid, pyramidal or quadragravure pattern on the surface. Prints of good quality and relative ease of operation are obtained with a preferred applicator roll having a trihelecoid pattern of between 80 and 300 lines per inch, with about 180 to 250 lines per inch being preferred, cut at an angle of from about 30° to about 60°, preferably about 45°, to the longitudinal axis and to a depth of from about one and one half mils to about 6 mils. Typical materials from which the applicator roll may be made include steel, brass, aluminum, Nylon, or Lucite. The roll may typically comprise a shaft of one material, with a shell or sleeve of a second material. A typical roll may be about one inch nominal diameter and about nine inches long. When a web or belt type applicator is used it is desirable although not always necessary that at each station of its path defining surface it be supported on the underside by a backing roll or other structure. By providing such support it is insured that developer material is adequately supplied to the applicator surface by the feed surface, that adequate doctoring is achieved and that subsequent development of the image is also achieved.

The developer feed surface may be of any suitable size and configuration. It may also take the form of a rotatably mounted roller or that of an endless belt or web. Like all materials employed the feed surface should be relatively resistant to aging, wearing and chemical attack by the developer. Considerable latitude is permitted in the selection of the feed surface when it is employed only as the feed surface. That is, when it is employed merely to supply or load the applicator surface with unmetered quantities of developer in undoctored configuration any developer feed system may be employed.

When, however, the feed surface is to serve both as a feeding and as a doctoring surface the surface should preferably be smooth to avoid any disfiguring of the applicator surface with which it comes in moving contact during the doctoring operation. Also, the material employed for the combination feed and doctoring surface should be relatively resilient having a Shore Hardness (A scale) durometer of from about 40 to about 90. Optimum print quality may be obtained with a durometer of from about 50 to about 60. Any suitable material may be selected for the feed surface. Typical examples of materials which may be employed for this surface include steel, silicone rubber, fluorosilicone rubber, Buna N rubber, Neoprene, urethanes and polyurethanes. When the roller type doctoring surface is employed typical elastomers include Fluorosilicone (W2249), Fluorosilicone Silastic LS63U, Silastic LS2311, all manufactured by Dow Corning. Also included are the following polyurethanes: Disogrin 6245 and Disogrin 7560, both products of Disogrin Industries. The nitrile copolymer Korilith manufactured by W. R. Grace Company is also useful.

When the feed and doctoring surface is in the form of a cylindrical roll, the roll should be accurately centered about its axis to provide uniform engagement with the developer applicator surface. A typical roller is comprised of about a ¾ inch steel shaft with an elastomeric shell or sleeve of about ⅛ inch thickness to provide a roller of about 1 inch outside diameter.

When separate rollers are employed for each of the developer feeding operation and the doctoring operation, the feed roller may have the characteristics described above and the doctoring roller may have the characteristics described with respect to the combination feed and doctoring roller or it may be in the form of a squeegee type roller.

Doctoring of the developer loaded applicator surface may also be accomplished by means of doctor blades. A principal doctor blade extending the entire length of the applicator surface may be used alone or in conjunction with edge and corner doctor blades. The doctor blades may be made of any suitable material which is relatively resistant to aging, wearing, and chemical attack by the developer liquid. Typical materials include steel, silicone rubbers, fluorosilicone, rubbers, urethanes, polyurethanes, Mylar (polyester). The blades should be rigid enough to withstand any pressure buildup due to developer being held back by the doctor blade. The principal doctor blade should contact the applicator surface along a line or narrow path to provide the desired metering of developer material to the applicator surface in doctored configuration. The edge and corner doctor blade should contact the edge of the applicator surface and the corner to remove excess developer and prevent the accumulation of developer along the corner of the applicator surface. Reference is hereby made to copending application of R. E. Smith, Ser. No. 838,141 entitled Developing Systems, filed concurrently herewith for further description of doctoring techniques which may be employed in the practice described herein.

Reference is also made to the copending application of G. Carr, Ser. No. 838,133 entitled Imaging Systems and Methods filed concurrently herewith for detailed discussion of skid roll and feed roll doctoring. Briefly, therein described are systems which achieve adequate doctoring by moving one surface, which may be a combination feed and doctoring surface or a doctoring surface, against an applicator surface such that there is a differential peripheral speed between the contacting surfaces. The surfaces are in moving contact under pressure such that the doctor surface provides a net wiping action against the applicator surface.

Any suitable developer material may be employed. Polar and nonpolar liquids and dry powdered material such as conventional toner or any particulate material which may be charged are useful. It is desirable that the developers be compatible with the particular materials they come in contact with during the operation of the developer module. Liquid developers may have pigments dispersed and/or dyes dissolved therein. Typical liquid developers useful may be selected from the commercially available water, oil and alcohol based inks and include among others as vehicles mineral oil, oleic acid, polypropylene glycol, mineral spirits, glycerol and sorbital.

Typical dry powdered materials include charcoal, carbon black and conventional toner. Any suitable colorant may be selected. Typical colorants include carbon black and other particular forms of carbon, iron oxide, zinc oxide, titanium dioxide, ultramarine blue, methylene blue, methyl violet tannate. Dispersants, humidity control and fixing agents may be added if desired.

Any suitable electrostatographic imaging surface may be employed. Suitable dielectric materials and photoconductors may be in the form of drums, plates, or webs. Typical materials include selenium or selenium alloys, zinc oxide binder layers, phthalocyanine binder layers or polyvinyl carbozol.

To minimize spillage and contamination of the mechanical movements by the developer material the developer module should be essentially fully enclosed to outside influence except for the supply of developer material to the developer bath in the module and for the opening necessary for the applicator surface to be placed in developing engagement with the photoconductor. The housing or tray of the developer module as depicted in FIG. 1 may be of one piece construction such as an extruded aluminum tray. To insure longetivity of operation the materials employed in the developer module are preferably not subject to attack by the particular developer employed.

The entire developer module is pivotally mounted about a shaft extending the longitudinal length of the module. Typically the feed or inking roll may serve as the pivot shaft so that when the cam is in camming engagement with the cam receiving surface of the end plates, the applicator surface is retracted from developing engagement with the photoconductor. Other suitable pivot means may also be used. The developer module is spring loaded against the photoconductor surface to provide the necessary engagement for development. Typically the applicator surface and photoconductor are in contact along a line or along a very small area and the contact may be under pressure. The pressure applied along this line of contact may vary with the overall speed of development and with the hardness of the contacting surfaces and photoconductor backup roll. Generally with higher speeds and harder materials, higher pressures are employed. Generally for development speeds of up to about 20 inches per second and steel applicator surfaces the pressure applied between the developer roll and the photoconductor is between about one and about three pounds per lineal inch.

The developer module may be employed in development systems achieving development at a rate of up to about 20 inches per second. Although development may be obtained at a speed less than about 2 inches per second, this speed is relatively impractical for commerical copying. Prints of good quality are obtained at preferred development speeds of from about 5 to about 15 inches per second with optimum print quality obtained at speeds of from about 8 to about 13 inches per second.

The developer module, particularly when employing the skid or feed roll doctoring techniques may be effectively employed at development speeds of up to about 250 inches per second.

Development may be achieved through conventional liquid devlopment techniques wherein electrophoretic movement of charged particles suspended in the developer liquid is obtained under the influence of an applied electric field. Preferably development is achieved with the polar liquid development technique disclosed by R. W. Gundlach in U.S. Pat. No. 3,084,043 wherein the entire developer liquid, including any dispersed or suspended pigment, is believed to creep up the sides of the depressed portions or valleys of the applicator surface and onto the imaging surface only where an electric charge is present on the imaging surface. In this technique substantially only the image areas are contacted with the developer liquid. Development with dry powdered developer material is obtained through the conventional xerographic developing mechanism wherein the powder is attracted from the applicator surface to those areas of the imaging surface which retain an electric charge. When a dry developer is employed, alternative feed means to the developer module may be desirable. Typically the conduit connecting the developer module and external supply may be positioned at a high level to feed from above into the bath in the developer module.

If desired, reversal development may be obtained by applying to the applicator a potential of the same polarity and in about the same amount as the charged areas of the image. A field then exists between the uncharged areas of the image bearing surface and the developer present on the applicator surface and no field exists between the charged areas of the image bearing surface and the developer. Therefore, when in developing engagement the developer material is attracted to the non-charged image.

DESCRIPTION OF PREFERRED EMBODIMENTS

The following nonlimiting preferred examples further define, describe and exemplify the technique of the present invention. All parts and percentages specified in the examples are by weight unless specified otherwise.

EXAMPLE I

A developer module similar that described in FIG. 1 is assembled from a one piece aluminum tray about 9 inches long. The cover and end plates are securely fastened to the developer tray and a machined surface stainless steel roll about three quarters of an inch in diameter is rotatably mounted in the end plates to provide a feed roll. An applicator roll of chrome plated steel about one inch in diameter and with a trihelicoid pattern of about 180 lines per inch cut at an angle of 45° to the axis and to a depth of about 0.0020 inches is also mounted in the end plates. The feed roll and applicator roll are spaced such that their rotating surfaces are about 0.005 inches apart. Corner and edge doctor blades about 0.030 inches thick are securely positioned at an angle of about 90° to the tangent of the point of contact with the developer roll. A principal doctor blade of stainless steel about 0.008 inches thick is positioned on the developer roll at an angle of about 60° to the tangent at the line of contact. The developer reservoir portion of the developer tray is loaded with developer of the following composition:

| | |
|---|---|
| Light Mineral Oil | 45 parts by weight |
| Microlith CT | 27 parts by weight |
| Ganex V216 | 23 parts by weight |
| VM550 Methyl Tannate | 4 parts by weight |

-continued

| | |
|---|---|
| Paraflint RG Wax | 1 parts by weight |

Microlith CT is a resinated predispersed carbon black pigment composed of about 40% carbon black and 60% ester-gum resin and manufactured by CIBA. Ganex V216 is an alkylated polyvinyl pyrrolidone dispersant manufactured by GAF Corp. VM550 is flushed pigment in mineral oil manufactured by Magruder Color Co. Paraflint is a hard synthetic wax manufactured by Moor and Munger Co.

Zinc oxide paper bearing an image to be developed is advanced over a backup roll and as the leading edge approaches the initial area of development the developer applicator surface is placed in developing engagement with the leading edge of the imaging surface by rotating the cam out of camming engagement with the cam receiving surface. Development is achieved at a speed of about 12 inches per second with the applicator roll moving at a peripheral speed of about 12 inches per second and having a peripheral speed of about 1.85 times that of the feed roll. The developer on the image bearing surface in image configuration is transferred to Xerox 4024 copy paper. A density of 0.8 and background of 0.005 in print quality are observed.

EXAMPLE II

The procedure of Example I is repeated with the exception that a urethane primary doctor blade about 0.075 inches in thickness having a Shore A durometer of about 75 – 85 and placed at an angle of about 45° to the tangent at the line of contact is employed. In addition, the zinc oxide paper is replaced by a phthalocyanine binder layer photoconductor and the developer employed comprises the following composition by weight:

| | |
|---|---|
| Drakeol | 38 parts by weight |
| Microlith CT | 38 parts by weight |
| Rucoflex TG-8 | 9 parts by weight |
| Ganex V216 | 14 parts by weight |

Drakeol 9 is mineral oil manufactured by Pennsylvania Refining Company. Rucoflex TG-8 is triethylene glycol dicaprylate manufactured by Hooker Chemical Company. Development and transfer are achieved in a manner similar to that described in Example I. The copy print is observed to have density of about 0.7 and a background of about 0.01 measured in the same manner as in Example I.

In general, the systems described herein provide a compact relatively clean operating development system of great simplicity in operation which may produce developed images of reduced background with little or no cumulative error in applying developer to the image portion of the image bearing surface. The advantages of the system and techniques of the invention may be graphically visualized by the fact that the several figures represent developer modules substantially drawn to scale.

Although specific materials and techniques are set forth in the foregoing disclosure and exemplary embodiments using the developing systems of this invention, these are merely intended as illustrations of the present invention. There are other materials and techniques and modifications of the present invention which will occur to those skilled in the art upon a reading of the present disclosure which materials, techniques and modifications are intended to be included within the scope of this invention.

What is claimed is:

1. An apparatus for developing an electrostatic latent image comprising:

1. means for creating and moving a latent electrostatic image on an imaging surface;
2. a developer module in actual or potential registration with a latent electrostatic image on the imaging surface and comprising
   a. a movable path-defining applicator surface having a pattern of lands and valleys to a depth of from about 1.5 mils to about 6 mils;
   b. an aperture in said developer module for selectively effecting transfer by electrostatic attraction of developer material between said applicator surface and a latent electrostatic image on said imaging surface when in register;
   c. developer feeding means within said developer module for applying developer material to the applicator surface;
   d. doctoring means mounted in doctoring arrangement with respect to said applicator surface for maintaining a metering amount of developer on the applicator surface;
   e. means for sequentially moving each part of said applicator surface past the feeding means and doctoring means and into developing configuration through said aperture with said imaging surface; and
3. means for developing engagement and disengagement of the developer module in register with movement of said imaging surface.

2. Apparatus of claim 1 wherein the doctoring means comprises a rotatably mounted cylindrical roll in pressure contact along a line on the applicator surface.

3. Apparatus of claim 1 wherein a differential peripheral speed is maintained between the applicator surface and the doctoring means.

4. Apparatus of claim 3 wherein the rotatably mounted cylindrical doctor roll also comprises the developer supply means.

5. Apparatus of claim 1 wherein the means for developing engagement and disengagement of the developer module is a cam and a spring.

6. Apparatus of claim 1 wherein the path defining applicator surface is a rotatably mounted cylindrical roll and wherein means are provided to move the applicator surface and the image bearing surface in developing engagement substantially only in the image defining area of the image bearing surface.

7. Apparatus of claim 1 wherein the doctoring means comprises edge and corner doctor blades and a principal doctor blade.

8. Apparatus of claim 7 wherein the principal doctor blade extends at least the entire length of the applicator roll.

9. Apparatus of claim 3 wherein the rotatably mounted cylindrical doctor roll also comprises the developer supply means.

10. Apparatus of claim 1 wherein the developer module is pivotally mounted in a support member about a rotatably mounted cylindrical developer feed roll, the applicator surface is a rotatably mounted cylindrical roll having a uniform patterned surface of raised portions and depressed portions, said applicator roll, feed roll and doctoring surface being securely mounted to maintain their relative positions.

11. Apparatus of claim 10 wherein the applicator roll has a surface trihelicoid pattern of between 80 and 300 lines per inch cut at an angle of from about 30° to about 60° to the longitudinal axis.

12. Apparatus of claim 5 further comprising mechanical programming means which activate the cam to provide developing engagement along a predetermined length of the image bearing surface.

13. Apparatus of claim 12 wherein the developer feed surface comprises a rotatably mounted cylindrical roll in developer feed engagement with a developer reservoir, the developer applicator surface comprises a rotatably mounted cylindrical roll, said developer feed roll and said developer applicator roll being rotatably mounted in common support means such that their longitudinal axis are parallel to each other.

14. Apparatus of claim 2 wherein the developer module is substantially self-enclosed and is pivotally mounted about the developer feed roll in an external support member.

* * * * *

UNITED STATES PATENT AND TRADEMARK OFFICE

CERTIFICATE OF CORRECTION

PATENT NO. : 3,942,474

DATED : March 9, 1976

INVENTOR(S) : Richard E. Smith and Jack R. Oagley

It is certified that error appears in the above-identified patent and that said Letters Patent are hereby corrected as shown below:

Column 3, line 20, delete "splts" and insert --spots--.

Column 4, line 19, delete "photoconductor" and insert --electrostatographic image bearing--.

Column 4, line 42, delete "programer" and insert --programmer--.

Column 4, line 57 after mounted, insert --on a feed roll shaft (end view shown) and mounted--.

Column 7, line 15, delete "copending" and insert --U.S.--.

Column 7, line 16 after 838,133, insert --now abandoned and--.

Column 9, line 47 after 838,133, insert --and now abandoned--.

Column 11, line 43, insert --to-- between "similar" and "that".

Signed and Sealed this

Twenty-first Day of September 1976

[SEAL]

*Attest:*

RUTH C. MASON
*Attesting Officer*

C. MARSHALL DANN
*Commissioner of Patents and Trademarks*